US009234389B2

(12) United States Patent
Umlor et al.

(10) Patent No.: US 9,234,389 B2
(45) Date of Patent: Jan. 12, 2016

(54) LADDER REST AND RESTRAINING DEVICE

(71) Applicants: Terrence L. Umlor, Kingsley, MI (US); Todd T. Sears, Traverse City, MI (US)

(72) Inventors: Terrence L. Umlor, Kingsley, MI (US); Todd T. Sears, Traverse City, MI (US)

( * ) Notice: Subject to any disclaimer, the term of this patent is extended or adjusted under 35 U.S.C. 154(b) by 0 days.

(21) Appl. No.: 14/602,042

(22) Filed: Jan. 21, 2015

(65) Prior Publication Data

US 2015/0204140 A1 Jul. 23, 2015

Related U.S. Application Data

(60) Provisional application No. 61/930,691, filed on Jan. 23, 2014.

(51) Int. Cl.
*E06C 7/42* (2006.01)
*E06C 7/48* (2006.01)
*E06C 1/04* (2006.01)

(52) U.S. Cl.
CPC ... *E06C 7/48* (2013.01); *E06C 1/04* (2013.01); *E06C 7/486* (2013.01)

(58) Field of Classification Search
CPC ..... E06C 7/486; E06C 7/48
See application file for complete search history.

(56) References Cited

U.S. PATENT DOCUMENTS

| | | | | |
|---|---|---|---|---|
| 5,215,163 | A * | 6/1993 | Kent et al. | 182/229 |
| 6,578,665 | B1 * | 6/2003 | DeBaca et al. | 182/107 |
| 6,962,237 | B2 * | 11/2005 | Underhill | 182/107 |
| 8,099,910 | B1 | 1/2012 | Gaines | |
| D683,054 | S | 5/2013 | Deardorf | |
| 8,439,163 | B2 | 5/2013 | Inman | |
| D706,953 | S | 6/2014 | Johnson | |
| D715,964 | S | 10/2014 | Von Hebestreit | |
| 2009/0000868 | A1 * | 1/2009 | Gaines | 182/106 |
| 2013/0055648 | A1 * | 3/2013 | Snyder | 52/11 |
| 2013/0199874 | A1 | 8/2013 | Davis, Jr. | |

OTHER PUBLICATIONS

Ladderport, www.ladder-port.com, ladderdock, 2013 retailer choice best new product winner, dated Mar. 25, 2014, 8 pages.

* cited by examiner

*Primary Examiner* — Alvin Chin-Shue
(74) *Attorney, Agent, or Firm* — Dinsmore & Shohl LLP

(57) ABSTRACT

A ladder rest and restraining device is provided for the edge of a roof or other elevated structure which is regularly or periodically accessed by means of an extension ladder or other similar device. The device may be permanently or removably mounted on the edge of the roof or structure where the ladder is normally positioned, to limit movement of the ladder horizontally, sideways, as well as vertically downward. The device includes an elongated primary support, a pair of legs extending from spaced apart locations of the primary support, the legs terminating in mounting feet. A plurality of restraining members extend from additional spaced apart locations of the primary support. The mounting feet are adapted to engage any of horizontal, vertical or angled surfaces associated with the elevated structure, such that a first sub-plurality of the restraining members are adapted to abut an underside of a selected rung to prevent downward movement of the ladder. A further sub-plurality of the restraining members are outwardly spaced from the first sub-plurality and adapted to limiting lateral displacement of the stanchion members in each of opposite directions.

6 Claims, 5 Drawing Sheets

LADDER REST AND RESTRAINING DEVICE

CROSS-REFERENCE TO RELATED APPLICATIONS

This application claims the benefit of U.S. Provisional Application 61/930,691 filed on Jan. 23, 2014, the contents of which are incorporated herein in its entirety.

FIELD OF THE INVENTION

The present invention relates generally to ladder support and restraint devices. More specifically, the present invention teaches a ladder rest and restraining device for utilization with a conventional extension ladder having a pair of elongated stanchion or side members and a plurality of climbing rungs mounted perpendicularly between. The restraint device of the present invention has a rigid primary horizontal member, mounting supports extending from the primary member for affixing to an elevated structure, and a plurality of restraining members projecting outwardly from the primary support member for abutting both the horizontal stanchions of the conventional ladder as well as providing underside support to a selected interconnecting climbing rung. The mounting supports are further capable of being secured to either of horizontal or vertical surfaces associated with the elevated structure such that that the restraining device is adaptable to restrain both horizontal and downwardly movement of a supported ladder.

BACKGROUND OF THE INVENTION

Access to the roofs of commercial buildings, or other elevated structures, is frequently provided by means of a separate extension ladder. The base of the ladder rests upon the ground or other foundation below the roof line and the upward portion of the ladder rests against the edge of the roof or protruding edge of a like structure.

Although ladders often provide treads on their base for traction at the base end, they are not permanently affixed, and the base of the ladder, when weight is on the ladder, may slide, either sideways or outwardly, resulting in instability, downward sliding of the ladder, and possible injury to any person using the ladder. Likewise, at the roof's edge, the surfaces may not be conducive to holding the ladder in one spot and, again, when a person is using the ladder, particularly with heavier loads or when weight shifts take place when gaining access to, or exiting from, a roof, forces may be exerted on the ladder to cause it to move sideways or downwardly, again providing instability and possible injury.

Habitually this problem has been dealt with, somewhat, by having a second person holding the base of the ladder. Even this, however, may not be sufficient if enough force is exerted at the top of the ladder to cause the ladder to move when a person at ground level has a poor purchase point, in terms of being a fulcrum, to prevent motion caused by significant force at the upper end.

Attempts in the prior art to address the issue of an unsecured upper extending end of a conventional ladder include the ladder port and ladder dock designs produced by Ladder Tech LLC. These include a variety of wall mount configurations each including a generally "L" shaped horizontal bracket aligning with an edge of the structure and with a pair of elongated abutments with upward curved outward ends affixed in laterally spaced and forward projecting fashion to a horizontal support edge associated with the "L" shaped bracket.

Selected variants of the Ladder Tech design further include upper vertically extending handhold supports as well as lower vertically and horizontally crosswise extending reinforcing members. A plurality of mounting tabs extending from the lower members further include apertures for receiving such as bolts for securing to wall support locations associated with the elevated structure. The lower mounting members can further include depth extending dimensioning supports to offset the ladder support bracket from such as a gutter.

Inman, U.S. Pat. No. 8,439,163, teaches a ladder safety device including a gutter guard, a ladder extender, a ground spike and a ladder show for improving the stability of a ladder placed against a structure with or without gutters. Davis, Jr., US 2013/0199874, teaches a ladder safety apparatus and method including a stabilizer bar for a top portion of a ladder, the stabilizer bar being configured to rest on a peaked roof top. A balance rail is provided for the top portion of the ladder to provide substantially upright handles for a user to grasp when the ladder is positioned on the roof top. The safety apparatus may be engaged to a ladder using one or more engagement rods.

Yet additional ladder safety rest and stabilizing devices include each of those depicted in Von Hebestreit, U.S. D715,964, and Johnson, U.S. D706,953. In the case of Von Hebestreit, a planar support skirt adapted for seating upon an elevated edge of the structure interconnects a vertically extending portion including a pair of spaced apart and elevating upper most edges for seating the ladder therebetween.

In the further case of Johnson, a roof top supported and width extending rod in turn includes a pair of transverse abutment posts. A pair of clamping members are supported upon the posts and sandwich therebetween the elongated side or stanchion members of the ladder.

SUMMARY OF THE INVENTION

The present invention discloses a ladder guide or stabilizer which can be permanently affixed on a roof or other structure, and which will hold a ladder in place, preventing significant sideways motion, by providing fixed resistance against the side stanchions of the ladder and preventing downward slippage by exerting permanent resistance on the underside of a selected rung of the ladder. The present invention further provides a ladder guide or stabilizer which can be efficiently secured to any of vertically, horizontally or intermediate angled support surfaces associated with the elevated structure.

According to a preferred embodiment, the support and restraining device is utilized with an elevated structure for securing an extension ladder, the ladder having a pair of elongated stanchion members, a plurality of climbing rungs mounted perpendicularly therebetween. The device includes an elongated primary support, a pair of legs extending from spaced apart locations of the primary support, the legs terminating in mounting feet.

A plurality of restraining members extend from additional spaced apart locations of the primary support. The mounting feet are adapted to engage any of horizontal, vertical or angled surfaces associated with the elevated structure. The restraining members can further be configured such that a first sub-plurality of the restraining members are adapted to abut an underside of a selected rung to prevent downward movement of the ladder, with a further sub-plurality of the restraining members being outwardly spaced from the first sub-plurality and adapted to limiting lateral displacement of the stanchion members in each of opposite directions.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As will be further described with reference to FIGS. 1-4, the present invention discloses a number of mounting arrangements associated with a ladder support and restraining device. The present device is particularly suited for securing to any of horizontal, vertical or angular surfaces associated with an elevated structure, the advantage of which being that it provides both underside support to a selected interconnecting rung of the ladder (typically including but not limited to an extension ladder), as well additionally restraining lateral displacement of the ladder.

Figure 1:
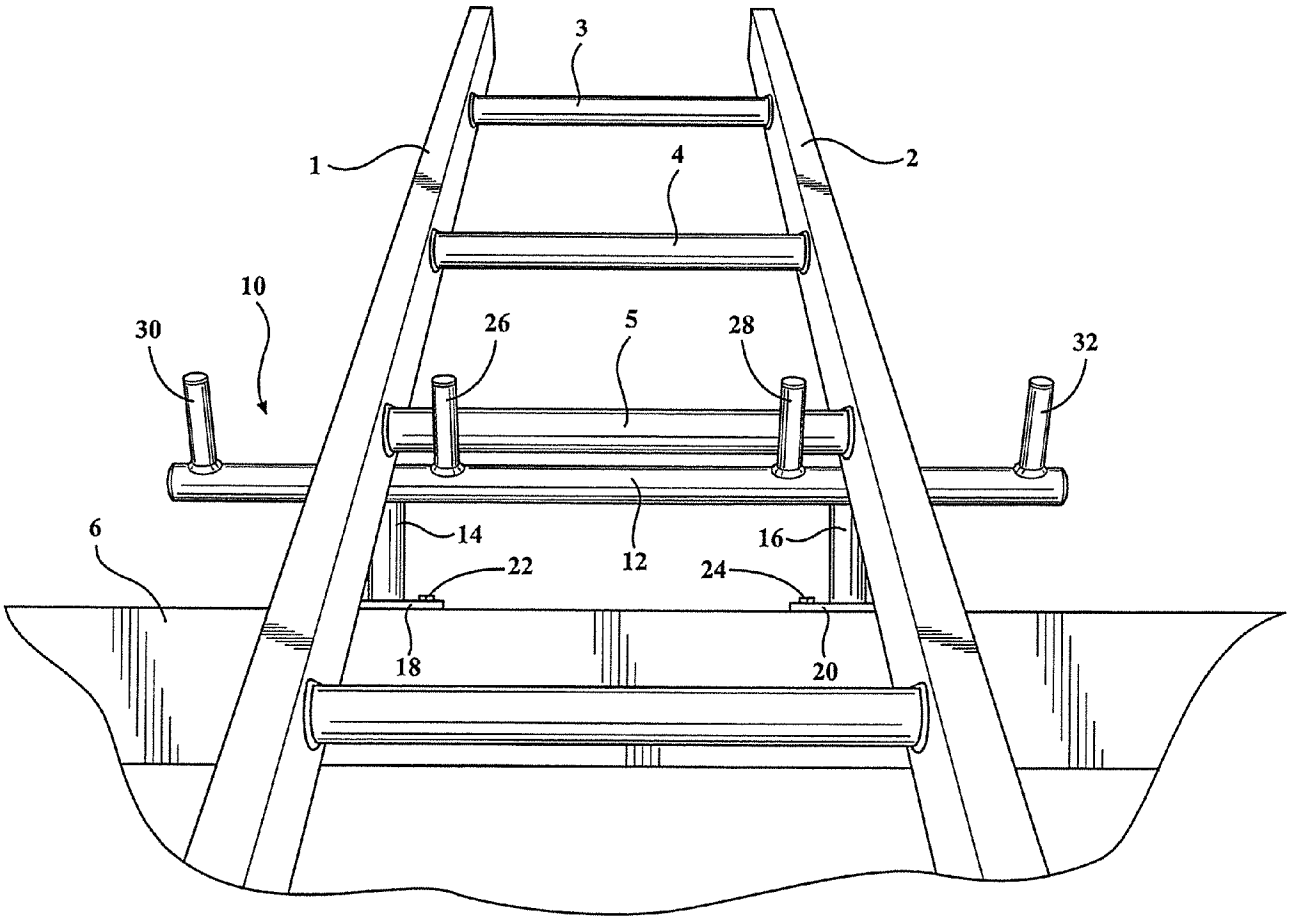
FIG. 1 is an upward looking environmental perspective of the ladder support and restraining device illustrated in a first affixed condition proximate a roof edge of an elevated structure and showing the upper portion of an extension ladder with outward stanchions straddled between inner and outer pairs of restraining members extending from a primary support, the inner pair of the restraining members further supporting underside locations of a selected ladder rung.
Figure 2:
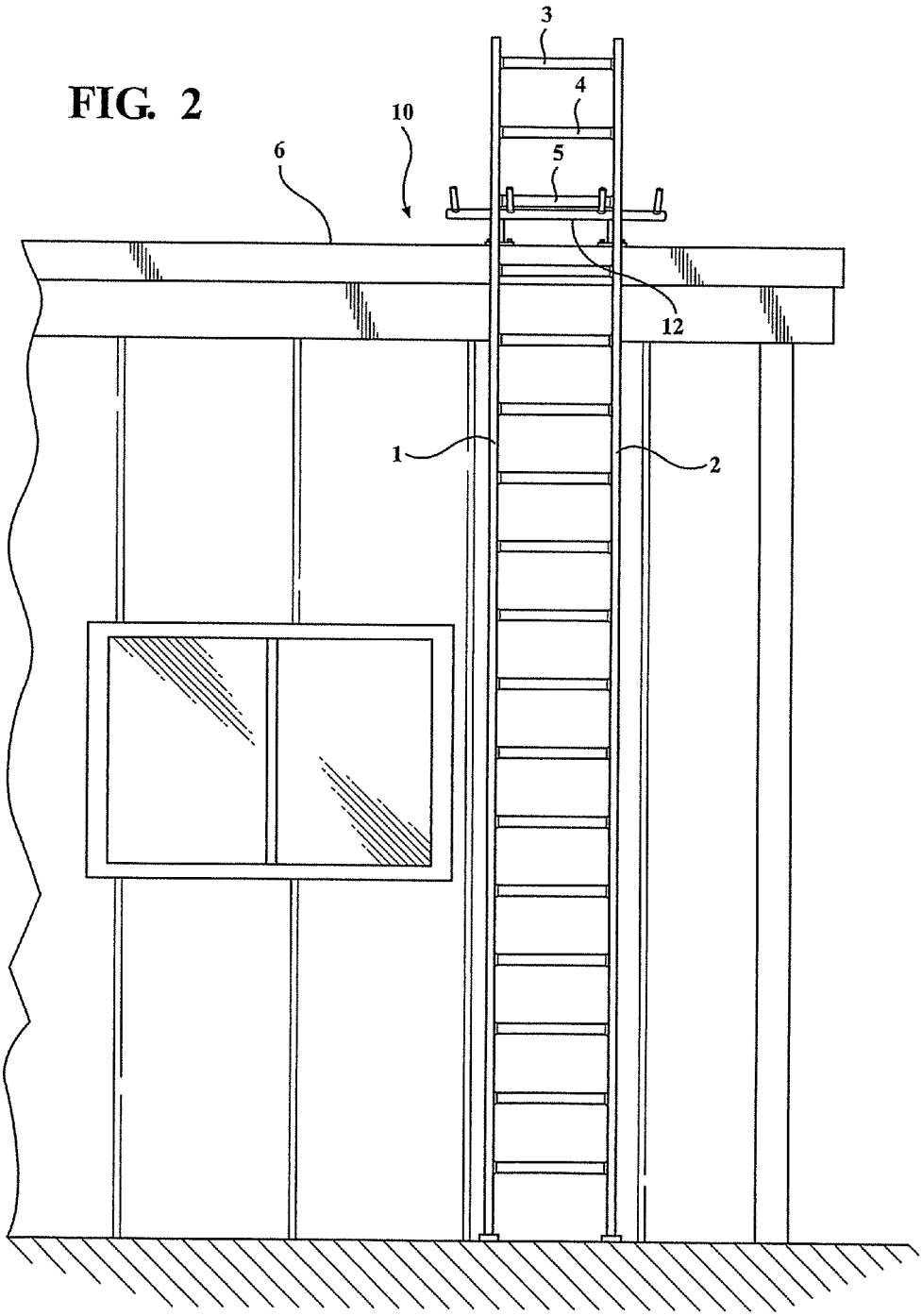
FIG. 2 is a distance plan view of the support and restraining device in combination with a ladder as shown in FIG. 1 extending upwardly from a ground location.

As shown in FIG. 1, the existing ladder includes a pair of outer and length extending sides or stanchions 1 and 2, between which are supported in interconnecting and spaced apart fashion a plurality of climbing rungs 3, 4, 5, et seq. Although shown in singular fashion, it is well understood that the convention ladder can further include the extension variety in which a pair of inter-displaceable and ratchet adjustable sections, similar to that shown, are provided for establishing a desired overall extending length. As is further known, such extension ladders (in particular those which may include more than two overlapping and inter-adjusting ratchet sections) provide support challenges often more significant than which is associated with a single or individual section ladder (again FIG. 1).

The device according to one non-limiting preferred embodiment, generally referenced at 10, includes an elongated primary support depicted at 12 and which can include any elongated and tubular or other cross sectional configured bar, rod or other member. A pair of legs, at 14 and 16, extend from spaced apart locations of the primary support 12 and, as shown, terminate in mounting feet 18 and 20, these being configured in the illustrated embodiment as flattened end supporting brackets, through which are configured holes for receiving individual pluralities 22 and 24 of mounting bolts (see in each of FIGS. 1 and 3) for mounting to a desired elevated surface location associated with a structure 6.

Figure 3A:
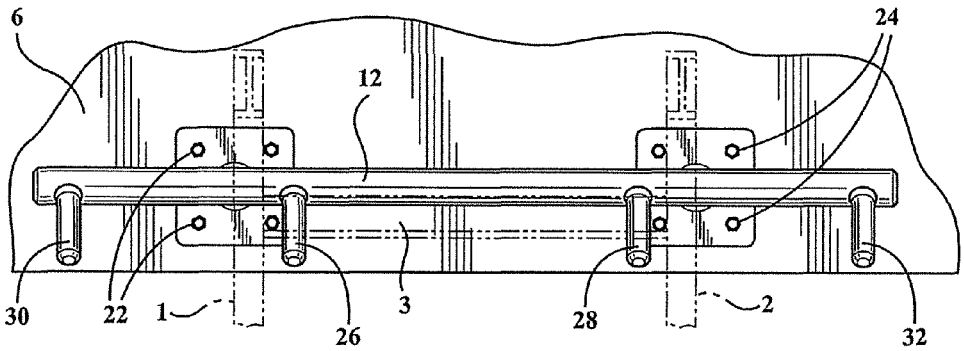
FIG. 3A is a top plan view of the support and restraining device taken from FIG. 1 and illustrating the ladder outer stanchions and selected inter-extending rung in phantom.
Figure 3B:
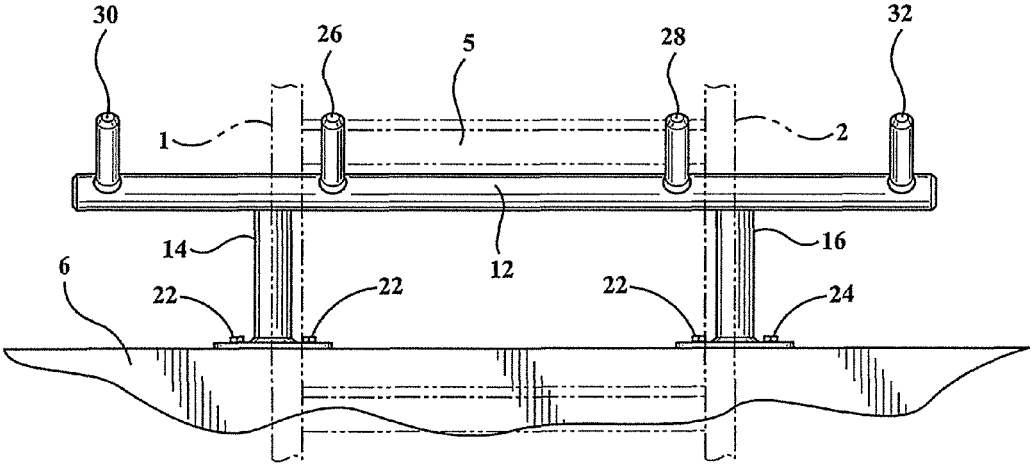
FIG. 3B is a front plan view of FIG. 3A.
Figure 3C:
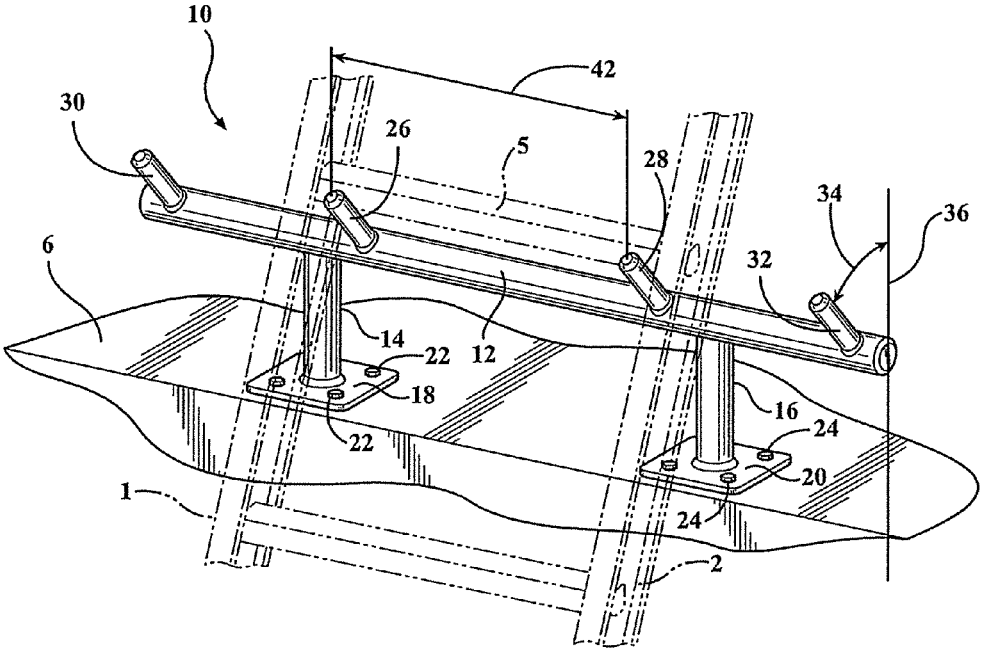
FIG. 3C is a slightly rotated perspective view of FIG. 3B and better showing the lateral and underside supporting aspects of the device with the ladder leaned there against.
Figure 3D:
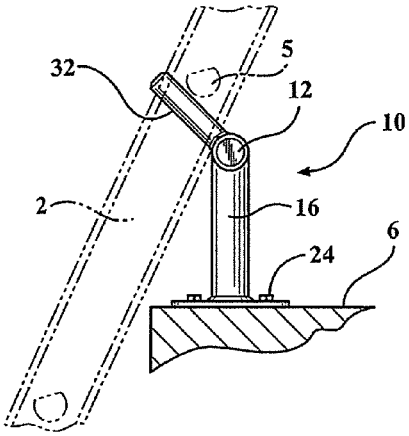
FIG. 3D is a side plan view of FIG. 3B and illustrating the angled supporting feature of the restraining members.
Figure 3E:
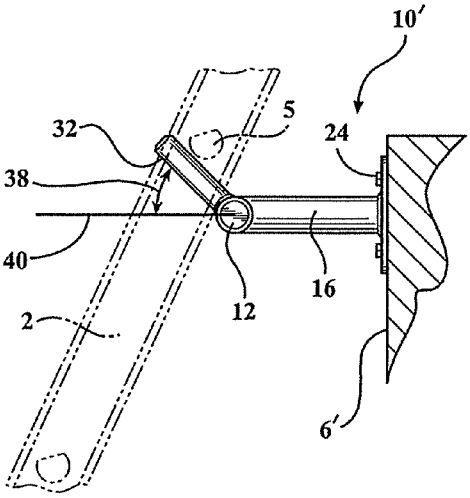
FIG. 3E is a further side plan view illustrating an alternate mounting arrangement of support device secured to a vertical face of the elevated structure proximate an upper edge.
Figure 4:
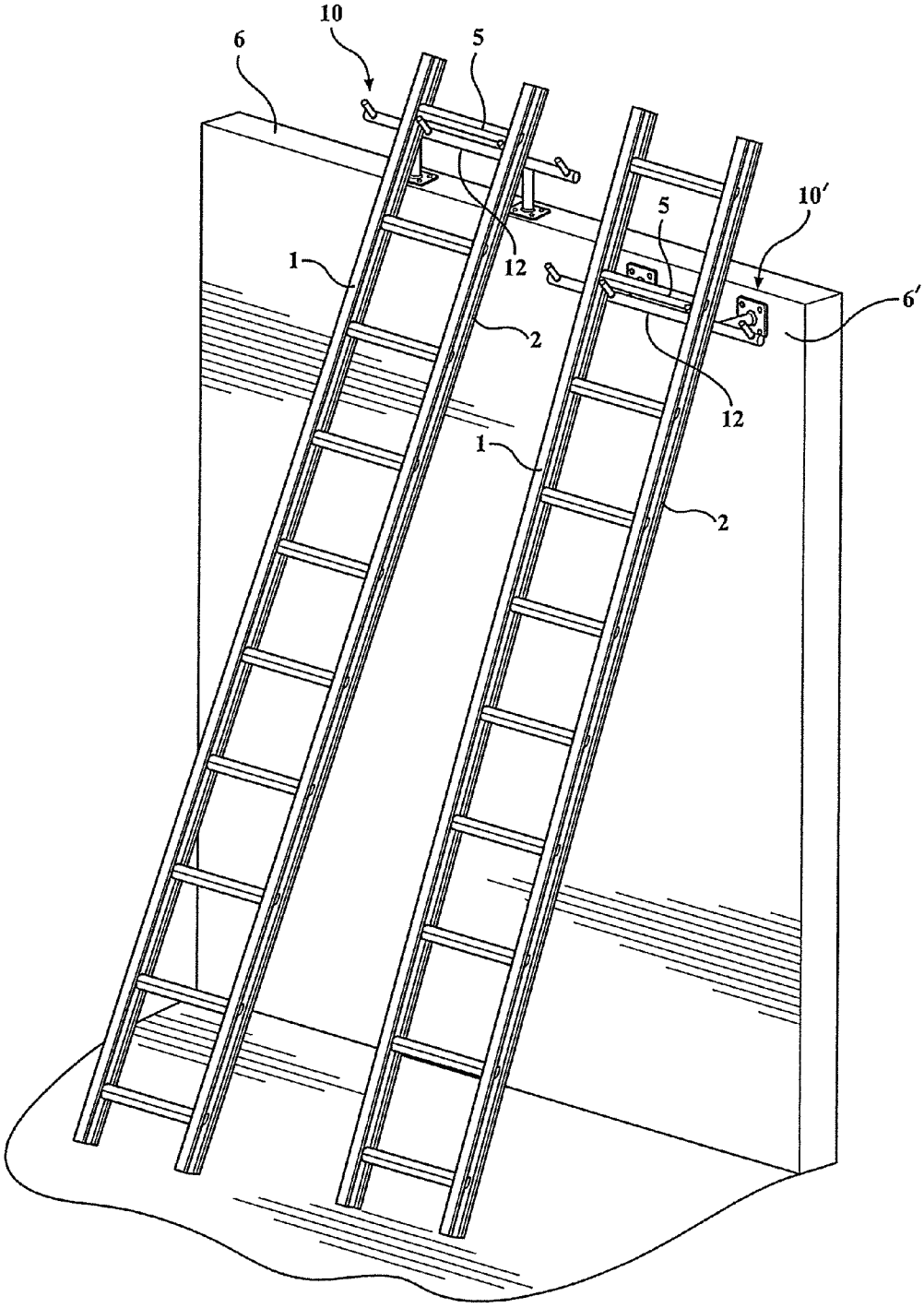
FIG. 4 is a further elevational and environmental view depicting both the elevated horizontal surface mounting arrangement of FIG. 1 in combination with the vertical surface mounting arrangement of FIG. 3E.

As further depicted in each of FIGS. 1-3D and additionally in FIGS. 3E-4, the device 10 is capable of being secured to either of a horizontal support surface, again at 6, as well as in an alternate arrangement 10' in which the device is secured against a vertical support surface 6' (see again FIG. 3E as well as environmental elevational perspective view of FIG. 4) of the elevated structure. As will be explained in additional detail, the present invention contemplates the ladder support and restraining device adaptable to being engaged against any of a horizontal, vertical or angled surface associated with the elevated structure.

A plurality of restraining members are shown and are referenced by a first sub-plurality of inner restraining members 26 and 28 extending from initial spaced apart locations associated with the primary support 12. A second plurality of outer restraining member 30 and 32 are additionally provided and extend from additional spaced apart locations of said primary support 12.

Without limitation, the pairs of restraining members can be configured to extend from any desired cross sectional angle such as depicted at 34 in FIG. 3C which extends at a selected angle not limited to 45° relative to a vertical axis 36 extending a cross wise direction through the primary support 12 mounted to a horizontal upper face 6 of the elevated support location (and which is in parallel with the extending direction of the legs 14 and 16). Without limitation, the pairs 26/28 and 30/32 of restraining members (also referenced as horns) can be provided in any desired shape configuration, and/or orientation relative to the tubular shaped primary support 12. By comparison, a similar cross sectional angular offset 38 (as compared to at 34) is depicted in FIG. 3E, relative to a horizontal cross sectional axis 40 through the primary support 12, in respect to the vertical mounting face variant of FIG. 3E.

In this manner, and upon securing the device 10 to any desired horizontal, vertical or angled elevated surface location, the first sub-plurality of the restraining members (represented by inner pair 26 and 28) are adapted to abut an underside of a selected rung (see rung 5 in FIG. 3C), in order to prevent downward movement of the ladder. A further or second outer sub-plurality of the restraining members (again represented by outer pair 30 and 32) are outwardly spaced from the first/inner sub-plurality 26/28 and are further adapted to limiting lateral displacement of the stanchion members 1 and 2 in each of opposite directions referenced by arrow 42 in FIG. 3C.

As is further best illustrated in FIG. 1, the first (inner) sub-plurality 26/28 of restraining members has a separation distance less than a width of the selected rung 5 extending between the extending stanchions 1 and 2 of the ladder. The second (outer) sub-plurality 30/32 of the restraining members further exhibits a separation distance greater than a width of the extending stanchions 1 and 2 of the ladder.

According to one non-limiting variant of the invention, the main support 12 of the device can exhibit a selected length of 30", such as which provides adequate spacing for supporting the inner 26/28 and outer 30/32 pairs of restraining members at width locations, which nest or straddle therebetween the outer extending stanchions 1 and 2 of the conventional ladder, the outer edge separation distance between stanchions 1 and 2 often being in the range of 20"-24" for an extension ladder of up to 24' to 30' on length. As best shown in FIG. 1, the objective is to provide combined underside support for the selected ladder rung 5, in combination with limiting the lateral displacement of the ladder (see again arrow 42 in FIG. 3C) prior to the inside faces of the outer stanchions 1 and 2 contacting abutting outer edges of the inner restraining members 26 or 28 and prior to the ladder sliding into contact with either of the outer restraining members 30 or 32.

Without limitation, the support device 10 may be affixed to a roof edge or upper portion of a vertical wall, or to any other elevated surface, so that the primary member 12 is substantially in a horizontal position. The legs 14/16 and associated bracket shaped mounting feet 18/20 may also be substituted by other structure for affixing the support device and this is envisioned to also include clamps or other mechanisms which may not necessitate drilling through the mounting surface of the structure at locations proximate a peaked or other angled support ledge.

In the embodiment of the invention as shown, multiple points of affixation are provided, this in order to prevent the possibility of the primary support 12 twisting or otherwise moving about a single point of affixation. That said, the present invention is not limited by the means or number of points of affixation.

As further depicted in the succession of views shown in FIGS. 3A-3E, the main support member and mounting legs or posts protruding therefrom may be, without limitation, positioned at any angle, such as between 90° and 180° from the extension of the legs from the mounting feet. As shown again in FIGS. 3C and 3E, a preferable angle established between a cross sectionally viewed restraining member and either of a horizontal or vertical extending axis is substantially 45°. As again shown in FIG. 4, utilizing a proximate or substantial 45° angle, the invention may be placed on the top of an elevated surface and support the stanchions and rungs of an access ladder, or it may be reversed and mounted on the vertical side wall, below the top of the elevated structure and, likewise, support the stanchions on rung. The angles may further be adjustable within the scope of the invention.

In each instance, in the use of the invention, the access ladder is typically held in place by its own weight, as well as the weight of any person utilizing the ladder. In one embodiment of the invention, the height of the restraining members (e.g. again at 26 and 28 in FIG. 1) or posts extending from the main support member between the ladder stanchions, do not exceed a height which would prevent the upper portion of an extension ladder from being extended or retracted, while holding the base portion of the ladder in the desired manner, and further to prevent downward vertical, or sideways, motion, which are all objects of the invention.

Having described our invention, other and additional embodiments will become apparent to those skilled in the art to which it pertains, and without deviating from the scope of the appended claims. Such can, without limitation, envision providing only a single inner pair of restraining members 26/28.

We claim:

1. A support and restraining device for utilization with an elevated structure for securing an extension ladder having a pair of elongated stanchion members and a plurality of climbing rungs mounted perpendicularly therebetween, said device comprising:

an elongated primary support;

a pair of legs extending from spaced apart locations of said primary support, said legs terminating in mounting feet;

a plurality of restraining members extending from additional spaced apart locations along said primary support and at an acute angle relative said legs taken from a cross sectional center line extending through said primary support;

said plurality of restraining members further including a first pair of inner members extending in parallel from said primary support with a distance between them less than a distance between said legs, a second pair of outer members located outwardly from said first pair of inner members at a separation distance greater than a distance between said legs; and said mounting feet adapted to engage any of horizontal, vertical or angled surfaces associated with the elevated structure, at least one of said inner pair of restraining members abutting an underside of a selected rung to prevent downward movement of the ladder, at least one of said outer pair of restraining members contacting the stanchion members to limit lateral sliding displacement of the ladder in each of opposite directions.

2. The device according to claim 1, further comprising said first pair of said restraining members having a separation distance less than a width of the rung between the extending stanchions of the ladder.

3. The device according to claim 1, further comprising said second pair of said restraining members having a separation distance greater than a width of the extending stanchions of the ladder.

4. The device according to claim 1, further comprising said restraining members extending at said acute angle relative to either of horizontal or vertical axes extending through the cross sectional center line of said primary support facilitating said device being mounted to either of vertical or horizontal surfaces of the elevated structure.

5. The device according to claim 4, said angle further comprising 45°.

6. The device according to claim 1, said elongated primary support having a length of 30".

* * * * *